US007104943B2

(12) United States Patent
Brintazzoli et al.

(10) Patent No.: US 7,104,943 B2
(45) Date of Patent: Sep. 12, 2006

(54) METHOD AND UNIT FOR FLEXING A FLAT BLANK FOR PRODUCING A RIGID PACKAGE

(75) Inventors: Roberta Brintazzoli, Monteveglio (IT); Valerio Fiorini, Bologna (IT); Stefano Romagnoli, Casalecchio di Reno (IT); Alessandro Minarelli, Bazzano (IT)

(73) Assignee: G.D Societa' per Azionivia, Bologna (IT)

( * ) Notice: Subject to any disclaimer, the term of this patent is extended or adjusted under 35 U.S.C. 154(b) by 114 days.

(21) Appl. No.: 10/951,443

(22) Filed: Sep. 28, 2004

(65) Prior Publication Data

US 2005/0096203 A1 May 5, 2005

(30) Foreign Application Priority Data

Oct. 8, 2003 (IT) ..... BO2003A0576

(51) Int. Cl.
*B31B 1/26* (2006.01)

(52) U.S. Cl. ..... 493/405; 493/356; 493/243

(58) Field of Classification Search ..... 493/405, 493/356, 245, 243, 260, 397, 910; 53/461, 53/466

See application file for complete search history.

(56) References Cited

U.S. PATENT DOCUMENTS

| | | | | |
|---|---|---|---|---|
| 487,967 | A * | 12/1892 | Roberts | 493/162 |
| 3,435,735 | A * | 4/1969 | Whitaker | 493/191 |
| 3,589,097 | A * | 6/1971 | Gianese | 53/506 |
| 3,802,235 | A * | 4/1974 | Bardenhagen et al. | 493/17 |
| 4,194,440 | A * | 3/1980 | Gorig | 493/105 |
| 4,562,687 | A * | 1/1986 | Green, Jr. | 53/376.5 |
| 4,708,704 | A * | 11/1987 | Focke et al. | 493/151 |
| 4,753,384 | A * | 6/1988 | Focke et al. | 229/160.1 |
| 5,066,270 | A * | 11/1991 | Tomanovits | 493/435 |
| 5,549,537 | A * | 8/1996 | Focke et al. | 493/162 |
| 5,674,542 | A | 10/1997 | Focke et al. | |
| 5,946,890 | A * | 9/1999 | Focke et al. | 53/466 |
| 5,996,318 | A * | 12/1999 | Draghetti | 53/466 |
| 6,244,436 | B1 * | 6/2001 | Boriani et al. | 206/268 |
| 6,286,291 | B1 * | 9/2001 | Tale' et al. | 53/456 |
| 6,606,840 | B1 * | 8/2003 | Focke et al. | 53/461 |
| 6,694,708 | B1 * | 2/2004 | Brizzi et al. | 53/462 |
| 7,001,320 | B1 * | 2/2006 | Focke et al. | 493/165 |

FOREIGN PATENT DOCUMENTS

| | | |
|---|---|---|
| DE | 35 36 791 | 4/1987 |
| DE | 44 04 289 | 8/1995 |
| EP | 1 396 430 | 3/2004 |

OTHER PUBLICATIONS

English Abstract of EP 1 396 430 dated Mar. 10, 2004.
English Abstract of DE 35 36 791 dated Apr. 16, 1987.
English Abstract of DE 44 04 289 dated Aug. 17, 1995.

* cited by examiner

*Primary Examiner*—Sameh H. Tawfik
(74) *Attorney, Agent, or Firm*—Ladas & Parry LLP

(57) ABSTRACT

A method and unit for flexing a flat blank having preformed fold lines; the flat blank is fed by a seat on a conveyor along a path through a flexing station, where a rigid folding body is rolled over the seat to fold the blank against two fixed folding spindles of the seat and about the preformed fold lines; and, on leaving the flexing station, the blank is allowed to spring back to its flat shape.

11 Claims, 4 Drawing Sheets

METHOD AND UNIT FOR FLEXING A FLAT BLANK FOR PRODUCING A RIGID PACKAGE

The present invention relates to a method and unit for flexing a flat blank for producing a rigid package.

The present invention may be used in the packing of cigarettes, and in particular for producing a rigid, hinged-lid packet, to which the following description refers purely by way of example.

BACKGROUND OF THE INVENTION

A rigid, hinged-lid cigarette packet comprises a cup-shaped bottom shell or container and a top lid joined to each other by a hinge. When the lid is in a closed position closing the cup-shaped bottom container, the packet is parallelepiped-shaped and defined laterally by two parallel, opposite (respectively front and rear) major lateral walls, and by two parallel, opposite minor lateral walls; and, between the major lateral walls and the minor lateral walls, are defined four longitudinal edges, which may be square, bevelled, or rounded (as described, for example, in Patent EP-A-0205766).

A rigid, hinged-lid packet of the type described above is normally produced from a flat, substantially rectangular cardboard blank having a number of preformed longitudinal and transverse fold lines, along which the blank is folded to form the packet.

In some cases, the longitudinal edges of the finished rigid packets fall short of the desired shape, and the lateral walls (particularly the major lateral walls) are not perfectly flat, on account of the tendency of the folded blank to spring back to its original flat shape. Such defects are particularly evident when the longitudinal edges are other than square, i.e. are rounded or bevelled. To reduce springback of the blank, it has therefore been proposed to equip packing machines with flexing units, which perform a pre-folding operation to flex the blanks along the fold lines.

One example of a flexing unit is given in Patent EP-B1-0391118, which describes a packing machine comprising a linear conveyor for feeding the blanks to a folding wheel; and fixed flexing guides located on opposite sides of the linear conveyor to fold portions of, and so flex, each blank. At the end of the fixed guides, each blank springs back to a substantially flat shape, and is then fed to the folding wheel. The flexing guides, however, are fairly bulky, can make maintenance of the conveyor fairly difficult, fail to provide for precise flexing, and, above all, subject the blanks to damage by friction.

Another example of a flexing unit is given in Patent US-A1-4708704, which relates to a packing machine in which a blank is fed to a flexing station located upstream from a packing line and having movable folding members for folding portions of the blank along respective longitudinal fold lines and against respective contoured spindles. The blank is then allowed to spring back to the flat shape before being fed to the packing line. Apart from being fairly complicated and bulky, the flexing station described above has the major drawback of requiring that the blank remain stationary in the same position for a given length of time, and as such involves major complications for use on a continuous packing machine.

By way of an alternative to flexing the blank, it has been proposed, as for example in Patent EP-B1-0205894, to shape the blank in a die negatively reproducing the desired shape of the finished packet. More specifically, the blank is fed into alignment with the die, and is made to adhere to the inner walls of the die by a contoured mating die. Tests show, however, that flexing the blanks provides for better quality packets than die-shaping.

SUMMARY OF THE INVENTION

It is an object of the present invention to provide a method and unit for flexing a flat blank for producing a rigid package, which eliminate the aforementioned drawbacks, while at the same time being cheap and easy to implement.

According to the present invention, there is provided a method of flexing a flat blank having preformed fold lines; the flat blank being fed by a seat on a conveyor along a first path through a flexing station; and the method being characterized in that, at the flexing station, a rigid folding body is rolled over the seat to fold the blank against the seat and about the preformed fold lines.

According to the present invention, there is provided a unit for flexing a flat blank having preformed fold lines; the unit comprising a flexing station, a seat for housing the flat blank, and a conveyor for feeding the seat along a first path through the flexing station; and the unit being characterized by comprising, at the flexing station, a rigid folding body, and an actuating device for rolling the folding body over the seat to fold the blank against the seat and about the preformed fold lines.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 4:
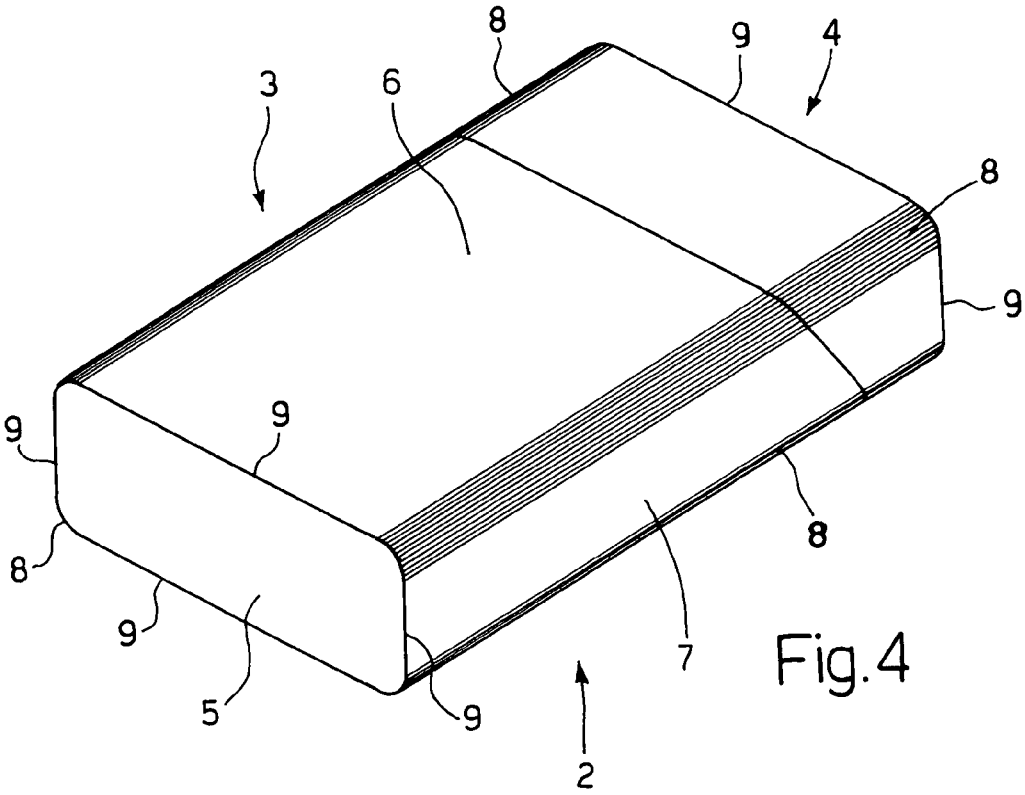
FIG. 4 shows a finished packet of cigarettes.
Figure 5:
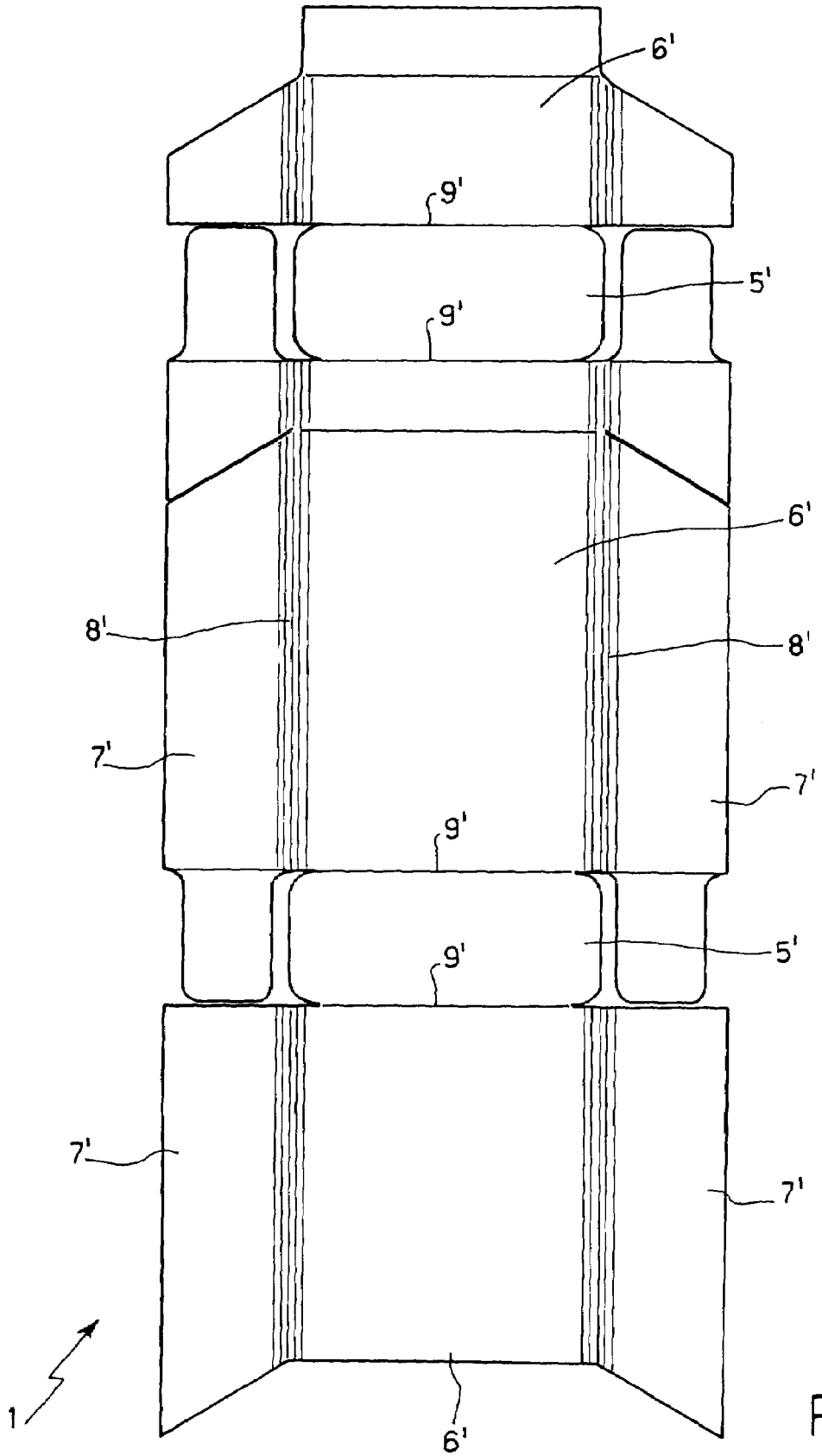
FIG. 5 shows a blank from which to produce the FIG. 4 packet of cigarettes.

Number 1 in FIG. 5 indicates as a whole a flat blank for producing a rigid, hinged-lid cigarette packet 2 (FIG. 4). As shown in FIG. 4, packet 2 comprises a cup-shaped container 3 having an open top end (not shown); and a cup-shaped lid 4 hinged to container 3 along a hinge (not shown) to rotate, with respect to container 3, between an open position and a closed position (shown in FIG. 4) respectively opening and closing the open top end.

When lid 4 is in the closed position, packet 2 is parallelepiped-shaped, and comprises a lateral surface; and two identical, facing, parallel, flat end walls 5 (only one shown in FIG. 4) bounding the lateral surface. More specifically, one end wall 5 defines a top wall of packet 2, and the other end wall 5 defines a bottom wall of packet 2. The lateral surface comprises two parallel, facing, flat major lateral walls 6 (only one shown in FIG. 4), and two parallel, facing, flat minor lateral walls 7 (only one shown in FIG. 4). More specifically, one major lateral wall 6 defines a front wall of packet 2, and the other major lateral wall 6 defines a rear wall of packet 2. Packet 2 comprises four longitudinal edges 8, each connecting a respective major lateral wall 6 to a respective minor lateral wall 7; and eight transverse edges 9, each connecting a respective end wall 5 to a respective lateral wall 6 or 7. More specifically, longitudinal edges 8 are rounded edges having a radius of curvature slightly greater than the radius of a cigarette, while transverse edges 9 are sharp square edges.

As shown in FIG. 5, flat blank 1 is substantially in the form of an elongated rectangle having a central longitudinal axis; and the parts of the blank are indicated using the same reference numbers, with superscripts, as for the corresponding parts of packet 2.

Blank 1 comprises two groups of preformed longitudinal fold lines 8', along which blank 1 is folded to define rounded longitudinal edges 8; and a number of preformed transverse fold lines 9', along which blank 1 is folded to define transverse edges 9. Between the two groups of longitudinal fold lines 8', transverse fold lines 9' define a number of panels 5' and 6' defining end walls 5 and major lateral walls 6 of packet 2 respectively; and each panel 6' has two wings 7' located on opposite sides of panel 6', separated from respective panel 6' by the two groups of longitudinal fold lines 8', and defining minor lateral walls 7 of packet 2.

Figure 1:
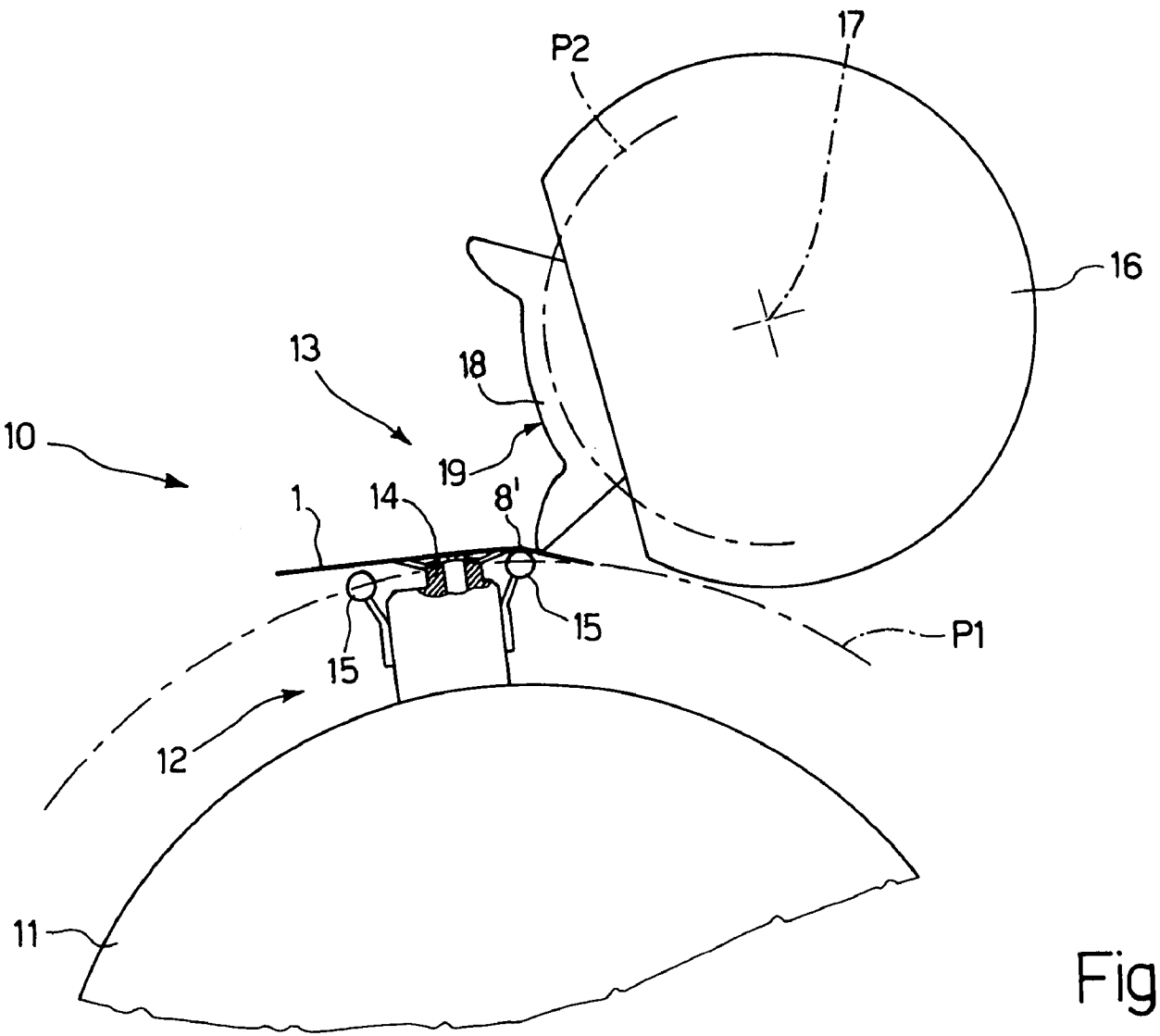
FIG. 1 shows a schematic, partly sectioned, front view of a flexing unit, in accordance with the present invention, of a machine for producing packets of cigarettes.
Figure 2:
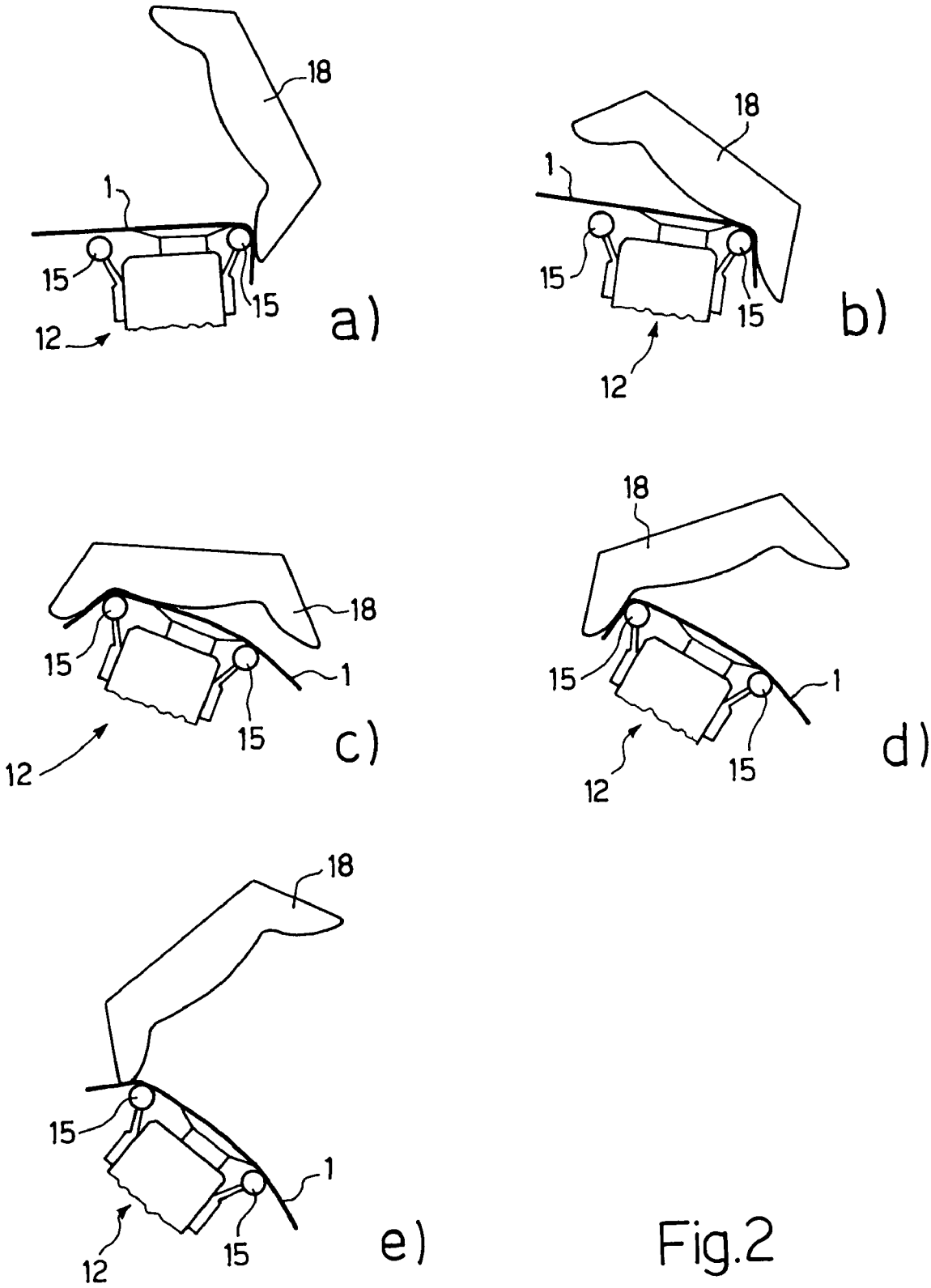
FIG. 2 shows part of the FIG. 1 flexing unit at successive operating steps.

FIG. 1 shows a flexing unit 10 for flexing blank 1, and which comprises a conveyor 11 having a number of peripheral seats 12 (only one shown in FIG. 1). More specifically, conveyor 11 is a wheel, which rotates preferably continuously and preferably at constant speed about a respective central axis (not shown, and perpendicular to the FIG. 1 plane) to feed blank 1, engaged by respective seat 12, along an arc-shaped path P1 through a flexing station 13. Blank 1 is advanced by respective seat 12, with longitudinal fold lines 8' perpendicular to path P1, and with transverse fold lines 9' parallel to path P1.

Figure 3:
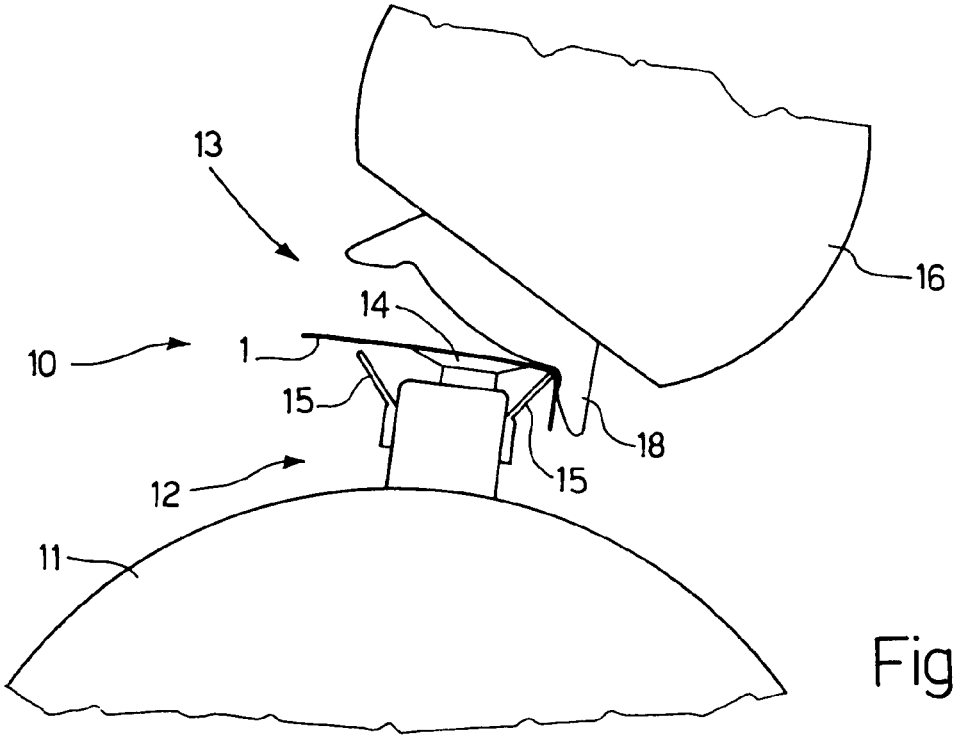
FIG. 3 shows a further embodiment of the FIG. 1 flexing unit.

Each seat 12 comprises a suction cup 14 for engaging a surface of relative blank 1 by suction, and for retaining blank 1 in a given position as seat 12 travels along path P1. Each seat 12 also comprises two folding spindles 15 located on opposite sides of seat 12, so as to face the two groups of longitudinal fold lines 8' of blank 1 engaged by seat 12; and each folding spindle 15 is fixed rigidly to relative seat 12, and has a top end shaped according to the shape and size of the longitudinal edge 8 to be produced when blank 1 is eventually folded. In the FIG. 1 embodiment, each folding spindle 15 has a rounded end to produce rounded longitudinal edges 8 of the type shown in FIG. 4; and, in the FIG. 3 embodiment, the end of each folding spindle 15 is shaped to produce bevelled or square longitudinal edges 8 (not shown). More specifically, in the FIG. 3 embodiment, each folding spindle 15 has a thin end to fold blank 1 along a single longitudinal fold line 8'; which type of pre-fold is commonly used for producing both bevelled and square longitudinal edges 8.

Flexing station 13 has a drum 16 which rotates preferably continuously and at constant speed about a respective central axis 17 parallel to the axis of wheel 11; and a rigid, substantially U-shaped folding body 18 is fixed to the periphery of drum 16, comprises a contoured surface 19, and is fed by drum 16 along an endless circular path P2.

As a seat 12 together with a respective blank 1 travels through flexing station 13, rotation of drum 16 causes surface 19 of folding body 18 to roll over seat 12 to fold blank 1 against folding spindles 15 and about longitudinal fold lines 8'. More specifically, surface 19 of folding body 18 is shaped to wrap blank 1 partly about) each folding spindle 15.

On leaving flexing station 13, blank 1 is allowed to spring back to its original flat shape; and wheel 11 then feeds the substantially flat blank 1 in known manner to a known packing line (not shown) where it is folded to form a corresponding packet 2.

In the embodiments shown, each seat 12 is maintained in a fixed position with respect to wheel 11 at flexing station 13, so that path P1 is arc-shaped. In an alternative embodiment, however, seat 12 may be moved with respect to wheel 11 (typically, oscillated under control of a cam system) at flexing station 13. It is important to note that each seat 12 may be fitted to wheel 11 to oscillate, under control of a cam system, to receive and release blank 1, and may be locked in position as it travels through flexing station 13.

Similarly, in the embodiments shown, folding body 18 is fitted rigidly to drum 16, so that path P2 is circular. In an alternative embodiment, however, folding body 18 may be moved with respect to drum 16 (typically, oscillated under control of a cam system).

Though the accompanying drawings relate to producing a packet 2 of cigarettes with rounded longitudinal edges 8, the teachings of the present invention obviously also apply to any type of square-edged, bevelled-edged, or so-called "pillow" packet 2 (of the type described in Patent Applications EP-0941943-A1, WO-0043289-A1, or WO-03026984-A1), and, obviously, spindles 15 must be shaped according to the shape of the edges to be produced. In the embodiment shown in the accompanying drawings, blank 1 is advanced by respective seat 12 with longitudinal fold lines 8' perpendicular to path P1, and with transverse fold lines 9' parallel to path P1, so as to flex blank 1 along longitudinal fold lines 8'. To be flexed along transverse fold lines 9', blank 1 must be advanced by respective seat 12 with transverse fold lines 9' perpendicular to path P1, and with longitudinal fold lines 8' parallel to path P1.

In a further embodiment, spindles 15 and/or folding body 18 may be heated electrically to increase the temperature of longitudinal fold lines 8' of blank 1 as they are being folded, and so make blank 1 easier to fold by locally reducing its mechanical resistance.

In the embodiments shown, the two spindles 15 of each seat 12 are physically separate, but could obviously be supported by a common member, and in particular could be formed by appropriately shaping the lateral edges of the member.

Flexing unit 10 as described above may obviously be used to advantage in any application requiring flexing of a flat blank prior to folding the blank to form a respective rigid package. For example, flexing unit 10 as described above may be used on a packing machine for producing rigid packages for confectionary (sweets, chocolates, chewing gum), food products, costume jewelry, toys, or stationery.

The invention claimed is:

1. A method of flexing a flat blank having preformed fold lines (8') along which the blank (1) is folded to define rounded or bevelled longitudinal edges (8); the method comprising the steps of:

feeding the flat blank (1) along a first path (P1) through a flexing station (13) on a conveyor (11) provided with a seat (12), which has at least one folding spindle (15) presenting a rounded or bevelled shape so as to be shaped according to the shape of the edge to be produced when the blank (1) is eventually folded;

flexing, at the flexing station (13), the flat blank (1) along the preformed fold lines (8') and about the folding spindle (15) by rolling a rigid folding body (18) over the seat (12) to fold the blank (1) against the seat (12), along the preformed fold lines (8') and about the folding spindle (15) to partly wrap the blank (1) about the folding spindle (15);

allowing the blank (1) to spring back to its flat shape downstream from the flexing station (13); and feeding the blank (1) in its flat shape to a packing line.

2. A method as claimed in claim 1, wherein the seat (12) comprises two folding spindles (15) located on opposite sides of the seat (12) and facing the preformed fold lines (8') of the blank (1).

3. A method as claimed in claim 1, wherein the folding spindle (15) of the seat (12) is a rigid, fixed folding spindle (15).

4. A method as claimed in claim 1, wherein, at the flexing station (13), the seat (12) is maintained in a fixed position with respect to the conveyor (11); the folding body (18) being fed cyclically along an endless second path (P2) by an actuating device (16).

5. A method as claimed in claim 4, wherein the second path (P2) is a circle.

6. A method as claimed in claim 4, wherein the first path (P1) is an arc.

7. A method as claimed in claim 4, wherein the folding body (18) is fed continuously and at substantially constant speed along the second path (P2) by the actuating device (16).

8. A method as claimed in claim 1, wherein the blank (1) is fed continuously and at substantially constant speed along the first path (P1) by the conveyor (11).

9. A method as claimed in claim 1, wherein the folding body (18) is substantially U-shaped.

10. A method as claimed in claim 1, wherein the seat (12) retains the blank (1) in a given position by suction.

11. A method as claimed in claim 1, wherein the preformed fold lines (8') about which the blank (1) is folded by the folding body (18) are perpendicular to the first path (P1).

* * * * *

UNITED STATES PATENT AND TRADEMARK OFFICE

CERTIFICATE OF CORRECTION

PATENT NO. : 7,104,943 B2
APPLICATION NO. : 10/951443
DATED : September 12, 2006
INVENTOR(S) : Roberta Brintazzoli et al.

It is certified that error appears in the above-identified patent and that said Letters Patent is hereby corrected as shown below:

On title page, item 73, "Azionivia" should read -- Azioni --.

Signed and Sealed this

Twelfth Day of June, 2007

JON W. DUDAS
*Director of the United States Patent and Trademark Office*